US006125561A

United States Patent [19]

Shull

[11] Patent Number: 6,125,561

[45] Date of Patent: Oct. 3, 2000

[54] METHOD FOR AUTOMATIC LOADING OF A SCRAPER BOWL

[75] Inventor: Andrew G. Shull, Washington, Ill.

[73] Assignee: Caterpillar Inc., Peoria, Ill.

[21] Appl. No.: 09/218,193

[22] Filed: Dec. 22, 1998

[51] Int. Cl.[7] ..... E02F 3/64

[52] U.S. Cl. ..... 37/415; 37/382; 701/50; 172/2

[58] Field of Search ..... 37/411, 414, 415, 37/416, 417, 195, 382, 348; 172/4, 4.5, 7, 5, 10, 2, 3; 701/50

[56] References Cited

U.S. PATENT DOCUMENTS

| | | | |
|---|---|---|---|
| 3,653,132 | 4/1972 | Campbell et al. | 37/8 |
| 3,762,076 | 10/1973 | Eftefield | 37/4 |
| 3,977,100 | 8/1976 | Boersma | 37/8 |
| 3,978,597 | 9/1976 | Brudnak, Jr. | 37/415 X |
| 4,107,859 | 8/1978 | Keith | 37/415 X |
| 4,449,733 | 5/1984 | Iida et al. | 37/415 X |
| 5,485,885 | 1/1996 | Matsushita et al. | 172/7 |
| 5,535,830 | 7/1996 | Matsushita et al. | 172/7 |
| 5,561,924 | 10/1996 | Ramey | 172/4.5 X |
| 5,564,507 | 10/1996 | Matsushita et al. | 172/7 X |
| 5,694,317 | 12/1997 | Nakagami et al. | 172/7 X |

*Primary Examiner*—Victor Batson
*Attorney, Agent, or Firm*—Howard & Howard

[57] ABSTRACT

The present invention generally provides a method of automatic control for a scraper bowl by measuring a first force as applied to the scraper bowl during forward movement of the scraper. Preferably, the first force is derived by measuring the hydraulic pressure within the hydraulic actuator that controls the scraper bowl. A target force value is then subtracted from the first force to obtain a force error signal which is converted into a position command signal. The position command signal is preferably used to automatically adjust the depth of cut performed by the scraper blade without diversion of the operator's attention. Additionally, the scraper blade can be further controlled by constraining the vertical adjustment speed signal of the cutting blade to prevent the cutting blade from digging to deep or breaking through the ground by providing an upper constraint limit and a lower constraint limit which can be set according to tractive effort and the material condition acting upon the scraper blade.

20 Claims, 2 Drawing Sheets

METHOD FOR AUTOMATIC LOADING OF A SCRAPER BOWL

TECHNICAL FIELD

The present invention relates to scrapers of the class employed for moving earth or other materials and more particularly to a method of controlling the speed and position of the scraper in preferred positions during operation.

BACKGROUND ART

The basic material handling scraper includes a tractor pivotally connected to a scraper bowl with both being supported by wheels. The bowl is equipped with a scraper blade which separates earth from the terrain over which the scraper is moving. This blade is normally situated in the forward portion of the bowl with the support wheels being located on the rear portion of the bowl. There is normally a hydraulic connection by rams between the tractor and the bowl which is controlled by the operator to lower the bowl into engaging position with the material beneath the bowl. As the vehicle moves over the material, the cutting action of the blade and the forward motion of the vehicle force the separated material into the bowl. Upon loading the bowl to its full capacity the operator raises the bowl to permit transport of the carried material to its unloading location.

The performance of the basic material handling scraper has been adversely affected in the past by the soil conditions in which it must operate. One major limitation to the efficient removal of material has been the constant adjustment which must be made by the operator to allow for uneven surface characteristics of the soil which is being removed. The operator must continually raise and lower the scraper blade to avoid slippage of the drive wheel, stalling of the engine or scalloping of the finished surface which can result from the depth variation of the soil surface and the density of the material being removed. A second limitation to the effectiveness of the basic scraper also results from these variations in soil conditions which adversely affect the flow of separated material from the front of the bowl to the rear of the bowl thereby decreasing the effective moving capacity of the scraper.

A considerable burden is therefore placed on the operator as any such adjustments of the scraper bowl position have necessarily been controlled manually while simultaneously attending to the steering of the scraper vehicle and to various other adjustments. To make efficient use of the scraper, the operator must continually estimate the optimum scraper bowl position for successive stages of material removal. Since the operator is not generally situated at a position where it is convenient to observe the scraper action, and since he cannot directly sense the forces reacting against the scraper, there is a great potential for inconsistent performance. This continued concentrated attention on the part of the operator results in fatigue and thus shorter shifts to achieve reasonably satisfactory operation. Additionally, inefficient manual adjustment typically requires additional movement of the scraper and therefore increased stress to the mechanical and hydraulic components.

DISCLOSURE OF THE INVENTION

The present invention overcomes the disadvantages described above by providing a method utilizing closed loop automatic control of the speed and position of the scraper bowl. A marked improvement in scraper efficiency can be realized if powered means are provided to automatically vary the scraper position to a greater extent than is inherent in the above described manual structure.

The present invention generally provides for the automatic control of the scraper bowl by measuring a first force as applied to the scraper bowl during forward movement of the scraper. Preferably, the first force is derived by measuring the hydraulic pressure within the hydraulic actuator that controls the position of the scraper bowl. By measuring the pressure within the actuator, a direct measure of the applied force of the material to the scraper blade can be determined.

A target force value is then subtracted from the first force to obtain a force error signal. The target force value can be automatically or manually input in relation to the condition of the material acting upon the scraper bowl such that materials such as soil, sand, clay, and gravel, and their condition: dry, wet, heavy, light, can be "dialed in".

The next step is to pass the force error signal through an amplifier to convert the amplified force error signal into a command signal. The command signal is preferably used to automatically adjust the depth of cut performed by the scraper blade without diversion of the operator's attention.

Additionally, the scraper blade can be further controlled by constraining the vertical speed of the cutting blade to prevent the cutting blade from digging to deep or breaking through the ground. Preferably, an upper constraint limit and a lower constraint limit can be set according to tractive effort and the material condition acting upon the scraper blade. Tractive effort refers to the effort required to traverse over a terrain. The adjustment speed of the scraper blade is therefore prevented from exceeding the upper constraint limit and the lower constraint limit prior to sending the command signal to the scraper blade.

BEST MODE FOR CARRYING OUT THE INVENTION

Figure 1:
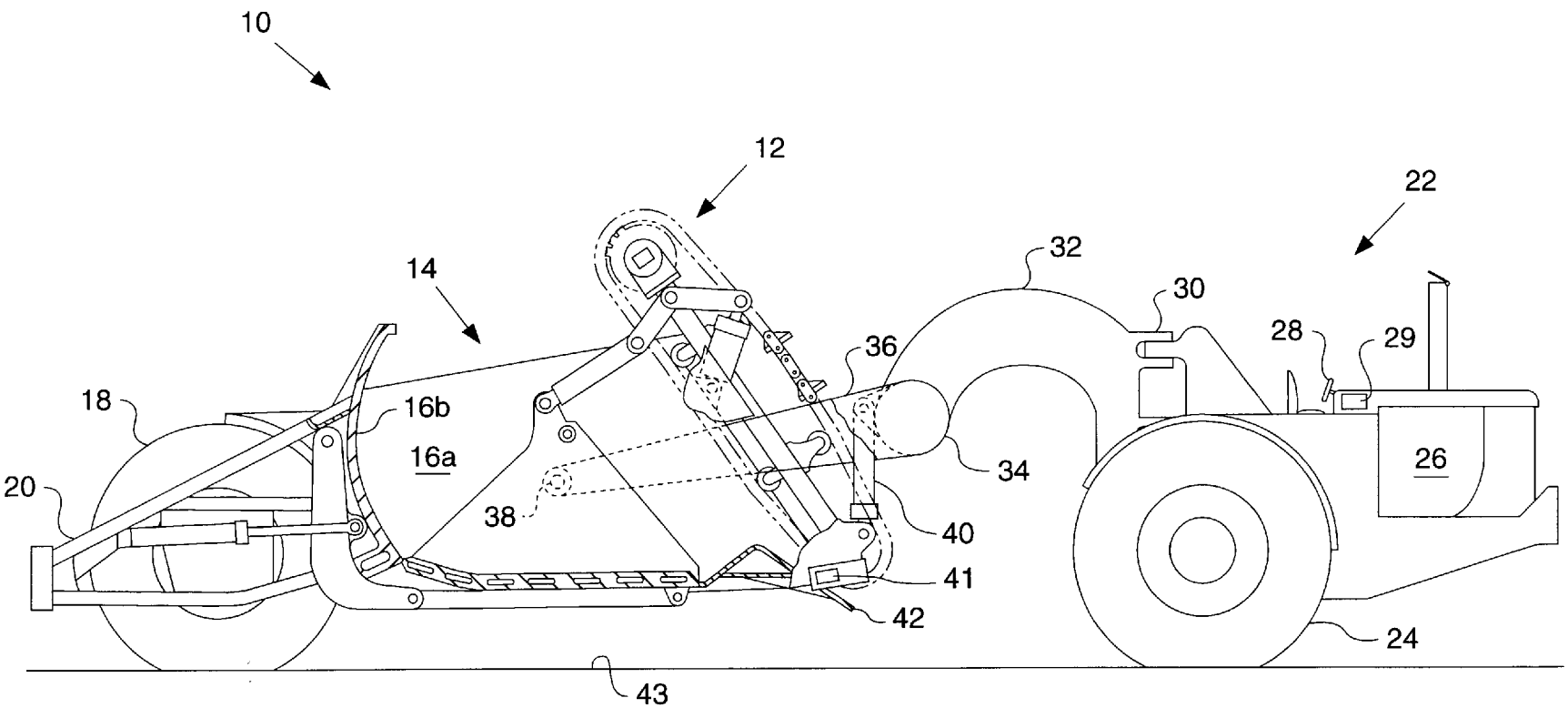
FIG. 1 is a general side view of a scraper with an adjustable scraper blade and an elevator depicted by breaking away the front section of the scraper bowl.

FIG. 1 illustrates a self loading scraper 10 according to the present invention. The self-loading scraper 10 is illustrated to include an elevator 12 which is automatically pivoted upward and forward as loading of a scraper bowl 14 progresses in order to maintain an optimum degree of inter-action between the elevator 12 and the material being loaded.

In a scraper 10 of this type, the bowl 14 is typically formed in part by sidewalls 16*a* which are connected by an arcuate rearwall 16*b*. The bowl 14 is supported at the back by rear wheels 18 which connect therewith through a frame 20. A tractor 22, having front wheels 24, an engine 26 and an operator station 28, is typically situated forward from the bowl 14 and is coupled thereto through a pivot hitch 30 and goose neck 32. One skilled in the art will realize that although a particular type of self-loading scraper 10 is provided for illustrative purposes, the present invention can be incorporated for use with various types and configurations of vehicles.

Goose neck 32 carries a transverse arm 34 and a draft arm 36 extending rearwardly from each end thereof to connect with the corresponding bowl sidewalls 16*a* through a pivot coupling 38. To control the elevation of the bowl 14, an actuator 40, such as a pair of hydraulic cylinder actuators is preferably connected between arm 34 and the forward portion of the bowl 14. Thus, by extending actuator 40, the bowl 14 can be lowered to cause a scraper blade 42 at the lower forward end thereof to bite into a material 43, such as a superficial layer of earth, to guide the material 43 upward into the bowl as the scraper 10 moves forward. When the bowl 14 has been loaded in this manner, actuator 40 is retracted to raise the bowl 14 for transporting the material to another site.

While the actuator 40 which controls the vertical height of the bowl 14 may be manually controlled by the scraper operator if desired, the structure is most efficiently utilized if automatic control is provided in accordance with the present invention so that the bowl 14 is continually adjusted such that the scraper blade 42 provides for optimal removal of material without requiring any diversion of the operator's attention. Preferably, a computer module 29 schematically shown at the operator station 28 calculates the depth of the bowl 14 in accordance with the present invention and in response to a sensor 41 located adjacent the actautor 40.

Figure 2:
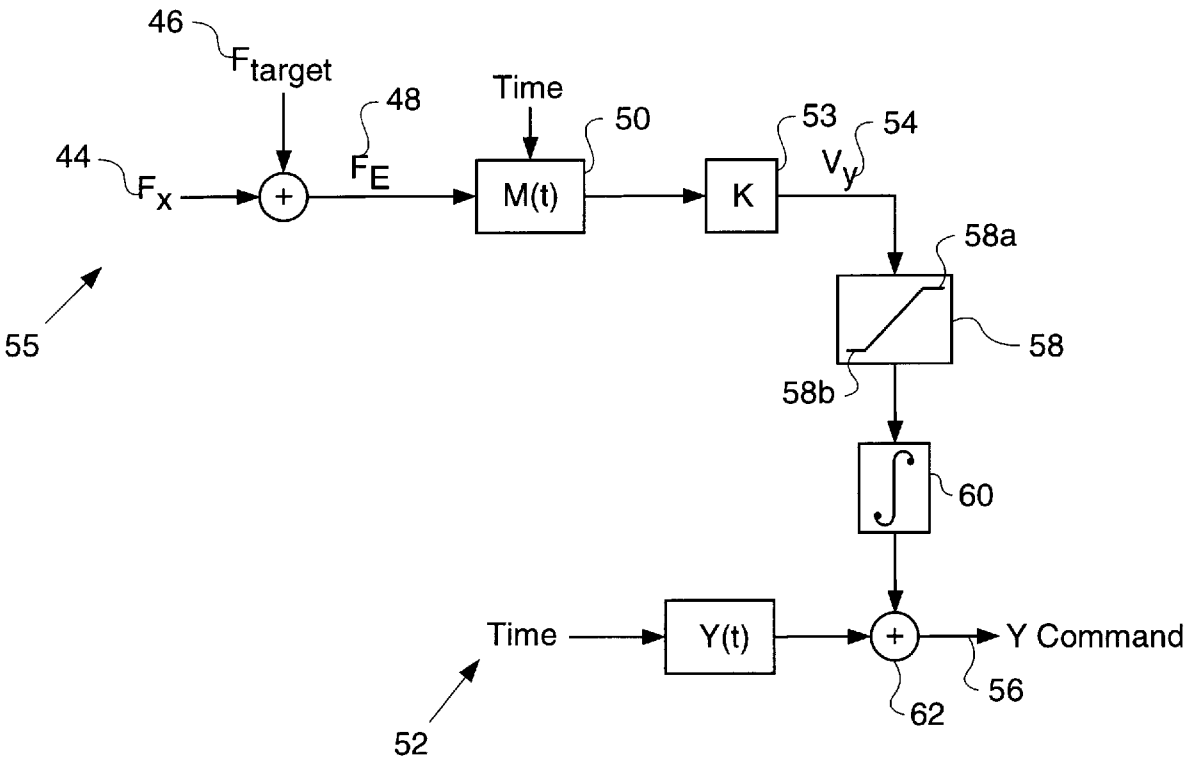
FIG. 2 is a schematic view of a control method for an adjustable scraper blade scraper.

Referring now to FIG. 2, there is schematically shown a suitable control method for this purpose. The present invention generally provides for automatic control of the scraper bowl 14 by measuring a first force 44 as applied to the scraper bowl 14 during forward movement of the scraper 10. Preferably, the first force 44 is derived by measuring the hydraulic pressure within the hydraulic actuator 40 with sensor 41. By measuring the pressure within the actuator 40, a direct measure of the applied force of the material 43 to the scraper blade 42 can be determined. This first force 44 is therefore available as an input to the control method 44 of the present invention.

A target force value 46 is then subtracted from the first force 44 to obtain a force error signal 48. The target force value 46 provides an objective criteria to measure the first force 44 thereto. The target force value 46 can be automatically or manually input in relation to the condition of the material 43 acting upon the scraper bowl 14. The present invention can therefore be adjusted to account for various materials and the various conditions of the material. For example, materials such as soil, sand, clay, and gravel, and their condition: dry, wet, heavy, light, can be "dialed in".

As stated above, the force error signal 48 is the difference or variance between the target force value 46 (desired state), and the first force 44 (measured state) of the applied force acting upon the scraper blade 42. The force error signal 48 is preferably time dependant by providing a time based multiplier 50 such that a time limit 51 can be set. The force error signal 48 is initially multiplied by zero (0) during the first few seconds after the scraper blade 42 is lowered to begin the material removal operation, but then quickly ramps to a multiplier of one (1). Accordingly, a smooth transition from an open-loop 52 (operator input) to closed-loop 55 (automatic control) is obtained during ground engagement. Further, by providing a time component, a specific time limit can be set such that the scraper blade 42 is automatically raised when the time limit is reached. This can be used to determine, for example, when the bowl 14 is full and operations should cease.

The next step is to pass the force error signal 48 through an amplifier 53 to convert the amplified force error signal 48 into a vertical adjustment speed signal 54 which can then be converted 60 into a position command signal 56. The position command signal 56 is preferably used to automatically adjust the depth of cut performed by the scraper blade 42 or to adjust the scraper bowl 14. Preferably, the depth of scraper blade 42 is adjusted upward if the first force 44 goes above the target force value 46 and the depth of scraper blade 42 is adjusted downward if the first force 44 goes below the target force value 46.

The scraper blade 42 can be further adjusted by limiting the vertical adjustment speed signal 54 prior to conversion 60 into the position command signal 56 to prevent the cutting blade 42 from digging too deep or breaking through the ground. Preferably, constraint limits 58 including an upper constraint limit 58*a* and a lower constraint limit 58*b* which can be set according to tractive effort, the effort required to travel over a given terrain, and the material condition acting upon the scraper blade 42. The vertical adjustment speed signal 54 is then modified by preventing the vertical adjustment speed signal 54 from exceeding the upper constraint limit 58*a* and falling below the lower constraint limit 58*b* prior to conversion 60 into the position command signal 56. The position command signal 56 is then fed to the scraper blade 42. In other words, the vertical adjustment speed signal 54 is modified by constraint limits 58 prior to the conversion 60 into the final command signal 56 such that the scraper blade 42 movments will not exceed the predetermined upper and lower limits 58*a*,58*b*.

The scraper blade 42 can be still further controlled by combining open-loop control 52 with closed-loop 55 control. The open loop 52 or manual control can be converted into the command signal 56 by summing 62 its signal with that from the conversion 60 prior to feeding the command signal 56 to the scraper blade 42. Thus, automatic control can therefore be maintained while allowing a manual operator override.

Industrial Applicability

In use, the present invention provides for the automatic depth control of the scraper bowl 14 by measuring with a sensor 41 a first force 44 as applied to the scraper bowl 14 during forward movement of the scraper 10 without diversion of the operators attention. The first force 44 is derived by the sensor which measures the hydraulic pressure within the hydraulic actuator 40 that controls the depth of the scraper bowl 14. In use, an operator manually inputs a target force value 46 to the computer module 29 depending on the condition of the material acting upon the scraper bowl 14, such that materials such as soil, sand, clay, and gravel, and their condition: dry, wet, heavy, light, can be "dialed in". A force error signal 48, being the difference between first force 44 and target force value 46, is then converted by the computer module 29 into a command signal 56 which automatically adjusts the depth of cut performed by the scraper blade 42. Similarly, an upper constraint limit 58*a* and a lower constraint limit 58*b* is set according to tractive effort and the material condition acting upon the scraper blade 42 to prevent the scraper blade 42 from digging to deep or breaking through the ground.

The foregoing description is to be exemplary rather than defined by the limitations within. Obviously, many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims the invention may be practiced otherwise than as specifically described. For that reason the following claims should be studied to determine the true scope and content of this invention.

What is claimed is:

1. A method to control a scraper bowl comprising the steps of:

(1) measuring a first force applied to said scraper bowl;

(2) subtracting a target force value from said first force to obtain a force error signal;

(3) calculating a position command signal in relation to said force error signal; and (4) adjusting said scraper bowl in relation to said command signal.

2. A method as recited in claim 1, wherein said first force is an applied force of a material acting upon said scraper bowl.

3. A method as recited in claim 1, wherein said target force value is manually set in relation to the condition of a material acting upon said scraper bowl.

4. A method as recited in claim 1, wherein said command signal adjusts the depth of cut performed by said scraper bowl.

5. A method as recited in claim 1, further comprising a hydraulic cylinder to raise and lower said scraper bowl, said hydraulic cylinder having a sensor and said steps of measuring said first force is measured through said sensor.

6. A method to control a scraper bowl comprising the steps of:

(1) measuring a first force applied to said scraper bowl;

(2) subtracting a target force value from said first force to obtain a force error signal;

(3) calculating a position command signal in relation to said force error signal;

(4) adjusting said scraper bowl in relation to said command signal; and (5) measuring an adjustment speed signal of said scraper bowl and preventing said adjustment speed signal from exceeding an upper constraint limit [of] or falling below a lower constraint limit.

7. A method to control a scraper bowl comprising the steps of:

(1) measuring a first force applied to said scraper bowl;

(2) subtracting a target force value from said first force to obtain a force error signal;

(3) calculating a position command signal in relation to said force error signal, wherein said command signal is the summation of a manual operator command and an automatic command;

(4) adjusting said scraper bowl in relation to said command signal.

8. A method to control the cutting depth of a scraper bowl comprising the steps of:

(1) measuring a first force applied to a scraper blade of said scraper bowl;

(2) subtracting a target force value from said first force to obtain a force error signal;

(3) calculating a position command signal in relation to said force error signal; and (4) adjusting said scraper blade depth in relation to said command signal.

9. A method as recited in claim 8, wherein said scraper blade depth is adjusted by a hydraulic cylinder, said first force being a pressure within said hydraulic cylinder.

10. A method as recited in claim 8, wherein said first force measures the applied force of a material acting upon said scraper blade.

11. A method as recited in claim 8, wherein said scraper blade depth is adjusted upward if said first force goes above said target force value and said scraper blade depth is adjusted downward if said first force goes below said target force value.

12. A method as recited in claim 8, further comprising the step of setting a time limit, said scraper blade being automatically raised when said time limit is reached.

13. A method to control the cutting depth of a scraper bowl comprising the steps of:

(1) measuring a first force applied to a scraper blade of said scraper bowl;

(2) subtracting a target force value from said first force to obtain a force error signal;

(3) calculating a position command signal in relation to said force error signal, wherein said command signal is the summation of an open loop command and a closed loop command; and (4) adjusting said scraper blade depth in relation to said command signal.

14. A method to control the cutting depth of a scraper bowl comprising the steps of:

(1) measuring a first force applied to a scraper blade of said scraper bowl;

(2) subtracting a target force value from said first force to obtain a force error signal;

(3) calculating a position command signal in relation to said force error signal;

(4) adjusting said scraper blade depth in relation to said command signal; and (5) converting an adjustment speed signal of said scraper blade and preventing said adjustment speed signal from exceeding an upper constraint limit or falling below a lower constraint limit.

15. A method to control the cutting depth of a scraper bowl comprising the steps of:

(1) measuring a first force applied to a scraper blade of said scraper bowl;

(2) subtracting a target force value from said first force to obtain a force error signal;

(3) calculating a position command signal in relation to said force error signal;

(4) adjusting said scraper blade depth in relation to said command signal;

(5) converting an adjustment speed signal of said scraper blade and preventing said adjustment speed signal from exceeding an upper constraint limit or falling below a lower constraint limit; and (6) setting said upper constraint limit and said lower constraint limit in relation to the condition of a material acting upon said scraper blade.

16. A method to control the cutting depth of a scraper bowl comprising the steps of:

(1) measuring a first force applied to a scraper blade of said scraper bowl;

(2) subtracting a target force value from said first force to obtain a force error signal;

(3) calculating a position command signal in relation to said force error signal;

(4) adjusting said scraper blade depth in relation to said command signal;

(5) converting an adjustment speed signal of said scraper blade and preventing said adjustment speed signal from exceeding an upper constraint limit or falling below a lower constraint limit; and (6) setting said upper constraint limit and said lower constraint limit in relation to the tractive condition of a material acting upon said scraper blade.

17. A system to control the cutting depth of a scraper bowl comprising:

a scraper bowl;

an actuator connected to said scraper bowl, said actuator operable to moveably actuate said scraper bowl;

a sensor adjacent said actuator, said sensor measuring a first force acting upon said scraper bowl;

a computer communicating with said sensor, said computer comparing said first force to a target force value signal to generate a force error signal, said computer calculating a position command signal in relation to said force error signal and communicating said position command signal to said actuator to adjust said scraper bowl.

18. A system as recited in claim 17, wherein said computer compares said position command signal to an upper constraint limit and a lower constraint limit, said computer adjusting said position command signal such that said position command signal is between said upper constraint limit and said lower constraint limit.

19. A system as recited in claim 17, wherein an operator input is summed with said position command signal prior to said computer communicating with said actuator to adjust said scraper bowl in relation to an applied force acting upon said scraper bowl.

20. A system as recited in claim 17, wherein said computer adjusts a scraper blade in relation to said position command signal.

* * * * *